United States Patent [19]

Harrison et al.

[11] Patent Number: 5,003,876

[45] Date of Patent: Apr. 2, 1991

[54] PRINTING APPARATUS WITH DUAL INKING SYSTEM

[75] Inventors: John R. Harrison, Baltimore; Michael W. Millard, Baldwin, both of Md.

[73] Assignee: The Ward Machinery Company, Cockeysville, Md.

[21] Appl. No.: 310,065

[22] Filed: Feb. 10, 1989

[51] Int. Cl.[5] ..... B41F 31/04; B41F 31/06; B41F 31/08; B41L 27/10

[52] U.S. Cl. ..... 101/350; 101/366; 101/425

[58] Field of Search ..... 101/363, 349, 350, 364–366, 101/170, 157, 169, 155, 167, 148, 208–210, 425, 423

[56] References Cited

U.S. PATENT DOCUMENTS 3,116,688 12/1959 Ward, Jr. et al. .
3,793,952 2/1974 Neumann et al. ..... 101/157
4,397,238 8/1983 Westerkamp .
4,461,211 7/1984 Wesselmann et al. .
4,590,855 5/1986 Schommer et al. .
4,735,144 4/1988 Jenkins .
4,774,884 10/1988 Sugimoto et al. ..... 101/170

OTHER PUBLICATIONS

International Paper Board Industry–Oct. 1988.

*Primary Examiner*—J. Reed Fisher
*Attorney, Agent, or Firm*—Boyce C. Dent; Edward D. C. Bartlett

[57] ABSTRACT

A printing apparatus includes a rotatable anilox roll engageable with a rotatable print cylinder for transferring ink thereto. A rotatable wipe roll and a doctor blade head are selectively engageable with different portions of the anilox roll to provide alternative wipe roll and doctor blade inking systems. Preferably both inking systems have substantially common ink supply and ink return paths with a valve being selectively operable to direct the ink supply path to either the wipe roll or the doctor blade head. Facilities for effecting a wash cycle may be provided to wash either inking system after use. Preferably an interlock arrangement prevents changing in use between the two inking systems until a wash cycle has been completed.

21 Claims, 8 Drawing Sheets

PRINTING APPARATUS WITH DUAL INKING SYSTEM

FIELD OF THE INVENTION

This invention relates to printing apparatus, particularly printing apparatus having a rotatable print cylinder which is inked by an ink roll. This invention is particularly applicable to flexographic printing, for example flexographic printing sections in sheet or container blank processing machines.

BACKGROUND OF THE INVENTION

When printing sheets between a rotatable print cylinder and a rotatable impression roll, the print cylinder is usually inked from an ink roll, often an anilox roll, having a film of ink thereon. In some printing machines or sections, the ink roll is inked by a wipe roll inking system. Whereas in other printing apparatus this is done by a doctor blade head having one or more doctor blades.

The two inking systems, i.e. wipe roll and doctor blade, have different inking characteristics. In the wipe roll system an ink fountain is usually formed in the upper nip trough between the wipe roll and the ink roll. Whereas in the doctor blade system, the fountain is often formed between two doctor blades in engagement with the ink or anilox roll.

The wipe roll inking system is good with thinner inks, poorer with thicker inks, but good for transferring large quantities of ink for broad printing coverage.

The doctor blade inking system is good with thicker inks, and good for fine-screen printing using a fine-screen engraved anilox roll. Also, the doctor blade system is better suited than the wipe roll system for use when it is desired to operate the ink roll at higher revolutions per minute.

If a printing machine capable of employing either inking system is required, then it has been necessary to include at least two printing sections, one having a wipe roll inking system and the other having a completely separate doctor blade inking system.

SUMMARY OF THE INVENTION

It is an object of the present invention to provide a printing apparatus having a larger range of inking capabilities than either a wipe roll inking system or a doctor blade inking system alone.

This object is achieved by having a wipe roll and a doctor blade head alternatively engageable with a common ink roll. Preferably, a common ink supply path can supply either system, whichever is selected to be operative, via a selectively positionable distribution valve.

This has the advantage of enabling printing employing either type of inking to be performed by the same printing section. Thus either broad coverage printing or fine-screen printing can be carried out with a single printing section.

Accordingly, therefore, there is provided by one aspect of the present invention a printing apparatus comprising a frame structure, a print cylinder rotatably mounted in the frame structure, an ink roll rotatably mounted in the frame structure and engageable with the print cylinder for transferring ink thereto, a wipe roll rotatably mounted in the frame structure, means for moving the wipe roll into and out of engagement with the ink roll, a doctor blade head assembly, means for moving the doctor blade head assembly into and out of engagement with the ink roll, and selection means for actuating the wipe roll moving means and the doctor blade head moving means for selectively engaging either of the wipe roll and the doctor blade head assembly with the ink roll and spacing the other of the wipe roll and the doctor blade head assembly from and out of contact with the ink roll to enable either a wipe roll inking system or a doctor blade inking system to be selected for printing.

Means may be provided for supplying ink to only one of the wipe roll and the doctor blade head assembly at a time, and only while said one is selectively engaged with the ink roll by the selection means.

Preferably, the wipe roll and the doctor blade head assembly are located on opposite sides of the ink roll. Also, the wipe roll, ink roll and doctor blade head assembly are preferably disposed below the print cylinder.

A common drain tray, disposed below the ink roll, may advantageously be arranged to collect excess ink flowing from the ink fountain of either inking system. The drain tray may have sumps on opposite sides connectable via individual ink return pumps to the supply of ink; this arrangement is particularly advantageous for handling return of excess ink when printing with very viscous inks.

Preferably, there is provided washing means for operating a wash cycle for washing ink from said printing apparatus after a printing run. Then, an advantageous optional feature of the invention is the provision of interlocking means for preventing the selection means from changing in use between the two inking systems until the washing means has been actuated to effect the wash cycle.

From another aspect of the present invention, there is provided a printing apparatus comprising a rotatable print cylinder, a rotatable anilox roll engageable with the print cylinder for transferring ink thereto, a rotatable wipe roll cooperable with the anilox roll to effect a wipe roll inking system for inking the anilox roll, a doctor blade head having at least one doctor blade cooperable with the anilox roll to effect a doctor blade inking system for inking the anilox roll, and means for permitting use of only one of the inking systems at a time, but enabling selection of either inking system.

Preferably, the doctor blade head has two doctor blades defining an ink reservoir therebetween. This provides the advantage that, because the ink fountain can be contained between the two blades and a portion of the surface of the anilox roll, the two blade head can be placed virtually anywhere around the periphery of the anilox roll.

The invention is particularly applicable to printing sections in flexographic sheet processing machines. A printing section having both wipe roll and doctor blade inking systems may advantageously be used to replace a conventional printing section. Therefore, according to yet another aspect of the invention there is provided a flexographic printing apparatus comprising a rotatable print cylinder, a rotatable impression roll cooperable with the print cylinder to print sheet material therebetween, an anilox roll cooperable with the print cylinder for transferring ink thereto, a wipe roll engageable with the anilox roll to form a wipe roll inking system for inking the anilox roll, a doctor blade head having at least one doctor blade engageable with the anilox roll to form a doctor inking system for inking the anilox roll, and means for supplying ink to either of the inking systems. The supplying means is selectively operable in a wipe roll mode or an alternative doctor blade mode. In the wipe roll mode the ink is supplied to an ink fountain formed in a nip between the wipe and anilox rolls, and in the doctor blade mode the ink is supplied to a different ink fountain defined between the anilox roll and the doctor blade head.

Other objects, features and advantages of the present invention will become more fully apparent from the following detailed description of the preferred embodiment, the appended claims and the accompanying drawings.

BRIEF DESCRIPTION OF THE DRAWINGS

In the accompanying drawings, in which in different Figures like reference characters indicate like parts.

DETAILED DESCRIPTION OF THE PREFERRED EMBODIMENT

The preferred embodiment of a printing apparatus according to the invention is shown in FIGS. 2 to 9. This incorporates a dual inking system in which either a wipe roll inking system or a double doctor blade inking system can be used in the alternative to provide, at choice, inking characteristics of either inking system. A preferred use of this new printing apparatus is illustrated in FIG. 1 in which a flexographic printer, die-cutter, creaser and slotter machine incorporates two printing sections each having the dual inking system of FIGS. 2 to 9.

Figure 1:
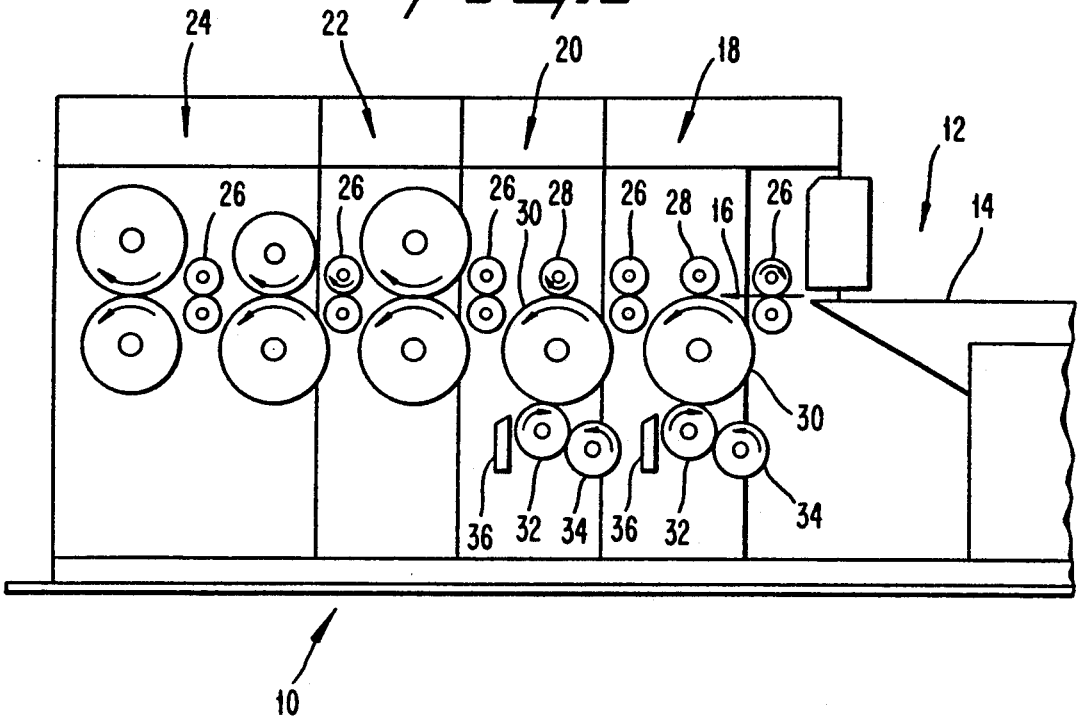
FIG. 1 is a simplified diagrammatic side elevational view of a container blank processing machine having two printing sections according to the invention.

In FIG. 1, the flexographic printing machine 10 has a feed section 12 for supporting a stack of container blanks on a platform 14 and for feeding the blanks one at a time from the bottom of the stack in the downstream direction 16 of the machine. Each blank then passes successively through a first printing section 18, a second printing section 20, a die-cutter section 22, and a yoked creaser and slotter section 24. The various rolls in these sections rotate in the directions indicated by arrows to feed the container blanks through the machine, pairs of feed rolls 26 feeding the blanks from one section to the next. Each printing section 18, 20 has an impression roll 28 cooperating with a print cylinder 30 carrying a printing plate, an anilox roll 32 for inking the printing plate, and a wipe roll 34 and a doctor blade head 36 on opposite sides of the anilox roll 32 for forming an ink fountain with the anilox roll. In printing sections 18, 20, each wipe roll 34 is shown in engagement with its respective anilox roll 32 and each doctor blade head 36 is shown spaced a short distance from the respective anilox roll 32. Thus, each printing section 18, 20 is shown in FIG. 1 with the wipe roll inking system operative and the doctor blade inking system disengaged. Either or both printing sections 18, 20 can be changed to render the wipe roll inking system inoperative and engage the doctor blade inking system. It will be noted that the dual inking systems, each comprising one wipe roll 34, one doctor blade head assembly 36, and one anilox roll 32, are disposed below the respective print cylinder 30 with the anilox roll 32 between the wipe roll 34 and the doctor blade head 36. In this way, an ink fountain can be established on either side of the anilox roll, this advantageously being either an external fountain with the wipe roll inking system or an internal fountain with the doctor blade head inking system.

One of the printing sections 18, 20 can be operated in the wipe roll mode of inking and the other in the doctor blade mode of inking. Alternatively, both printing sections 18, 20 can be operated in the wipe roll mode, or both in the doctor blade mode. Further, there could be only one printing section, or more than two printing sections, e.g. three sections to accommodate three primary colors.

Figure 2:
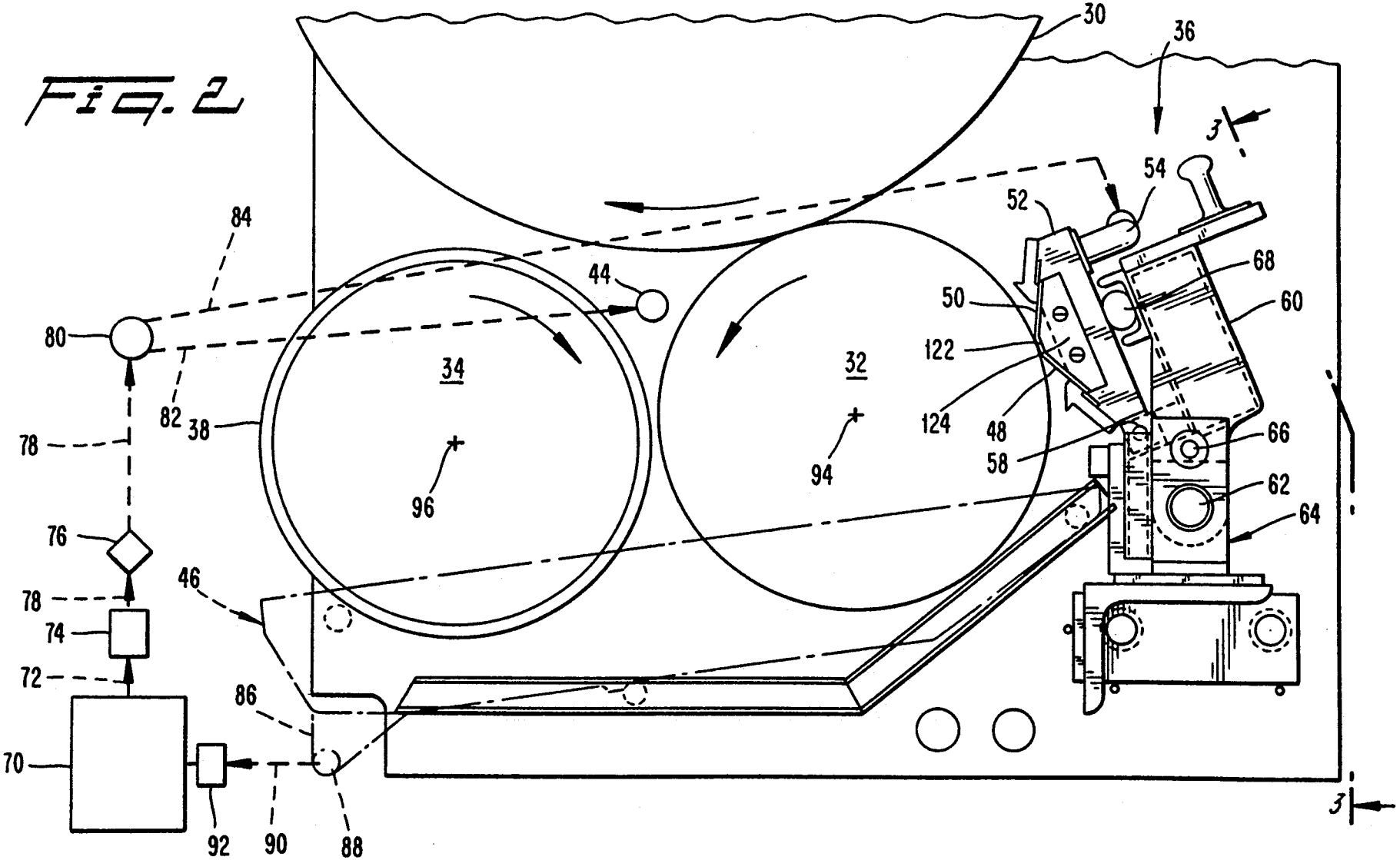
FIG. 2 is a diagrammatic side view, including a schematic indication in broken lines of the ink flow, of a portion of either of the printing sections of the machine of FIG. 1, but viewed from the opposite side to FIG. 1.

FIG. 2 illustrates the lower portion of either printing section 18 or 20, but from the opposite side of the machine 10 to that shown in FIG. 1. For ease of understanding, some parts have been omitted, some illustrated in broken lines, and a resilient cover 38 of the wipe roll 34 shown in section. The print cylinder 30, anilox roll 32, and wipe roll 34 rotate in the directions of their arrows.

The wipe roll 34 is shown in an inoperative position in FIG. 2 spaced a short distance from the anilox roll 32. The wipe roll 34 is journalled in a pivotal frame and can be moved into nipping contact with the anilox roll 32 by two adjustable air cylinders 40 (illustrated in FIG. 6). Similarly, the anilox roll 32 is journalled in another pivotal frame and moved into adjustable nipping contact with the printing plate of the print cylinder 30 by another pair of air cylinders 42 (illustrated in FIG. 6). When the wipe roll inking system is operative, the wipe roll 34 engages the anilox roll 32, and ink flows out of pipe outlet 44 into the trough of the upper nip between the wipe and anilox rolls 34, 32. This forms an ink fountain between these rolls with ink flowing out of each end of the upper nip trough and falling into a drain tray or ink pan 46 (shown in broken lines) located below both the wipe roll 34 and the anilox roll 32 and slopping downwards to the left in FIG. 2. When the wipe roll inking system, after use, is rendered inoperative, inter alia, the ink flow from outlet 44 is stopped, the rolls cleaned by washing, and the wipe roll 34 pivoted away from the anilox 32 to the spaced position shown in FIG. 2.

The doctor blade head assembly 36 has, mounted on a body 52, a lower forwardly directed doctor blade 48 and an upper reverse angle doctor blade 50. As shown in FIG. 2, the doctor blades 48, 50 are in engagement with the anilox roll 32 and the doctor blade head assembly 36 is in the operative position. In this operative position, ink is supplied to the top of the doctor blade body 52 via an inlet pipe 54, the ink filling an open, outwardly facing reservoir cavity formed between the body 52 and the doctor blades 48, 50. The surface of the anilox roll 32 closes the open side of this ink reservoir cavity (see also FIG. 4). Outlet pipes 56 (see FIGS. 3 and 4) at each end of the body 52 discharge excess ink from this ink reservoir cavity into the drain tray 46. The head 52 is pivotally mounted by a pivot pin 58 at each end on a frame 60. The frame 60 is pivotally mounted by a pair of pivots 62 (see also FIG. 3) to a portion 64 of the main frame structure of the respective printing section 18, 20 of the machine 10. The frame 60 can be pivoted to the right (i.e. clockwise in FIG. 2) for maintenance on the doctor blade body 52, doctor blades 48, 50 etc. In the position shown, the frame 60 is locked at each end to the main frame portion 64 by a removable locking pin 66. An air tube 68, operative between the locked frame 60 and the pivotal head 52, resiliently urges the doctor blades 50, 48 into controlled contact with the surface of the anilox roll 32.

Both inking systems, i.e. wipe roll and doctor blade, share the same ink circulation system. This comprises an ink supply 70, e.g. a drum or bucket of ink, an ink supply pipe 72 inserted in the ink supply 70 and connected to the inlet of an ink supply pump 74, and a filter 76 connected by piping 78 between the outlet of the supply pump 74 and a two-way selective distribution valve 80, i.e. the valve 80 has one inlet and two alternative outlets. One outlet of the valve 80 is connected by piping 82 to the pipe outlet 44 above the nip of the wipe roll 34 and anilox roll 32. The other outlet of valve 80 is connected via piping 84 to the inlet pipe 54 of the doctor blade body 52. Ink is thus supplied by the pump 74 to either the wipe roll 34 or the doctor blade head assembly 36 depending upon the position of the valve 80. In either case, excess ink flows into the drain tray 46 and drains to two spaced-apart side sumps 86 therein (only one sump can be seen in FIG. 2), an outlet 88 of each sump 86 being connected by return piping 90 to the ink supply 70 via an ink return pump 92. Thus, whichever inking system is selected and in operation, the ink fountain of that system with the anilox roll 32 is kept filled to a certain level with excess ink supplied by the supply pump 74 being returned to the ink supply container 70 by the ink return pump 92. The return pump 92 preferably is operated at an effective pumping rate greater than that of the supply pump 74.

It will be noticed that the doctor blades 48, 50 contact the surface of the anilox roll 32 at a location above the rotational axis 94 of the anilox roll 32 with the doctor blade body 52 leaning towards the upper portion of the anilox roll 32. Also, the rotational axis 96 of the wipe roll 34 is spaced a little way below the anilox axis 94. This arrangement allows the two inking systems to be conveniently grouped together below the print cylinder 30 and permits each printing section 18, 20, to take up no more machine space than a single conventional inking system, i.e. no more machine space is needed than for a conventional wipe roll inking system or for a conventional doctor blade inking system. The anilox roll and the print cylinder 30 rotate in opposite rotational directions but at the same peripheral speed. The anilox roll 32 and wipe roll 34 (when operative) also rotate in opposite directions, but with the wipe roll 34 having a lower peripheral speed than the anilox roll so creating slipping of the anilox roll surface over the resilient wipe roll cover 38.

Figure 3:
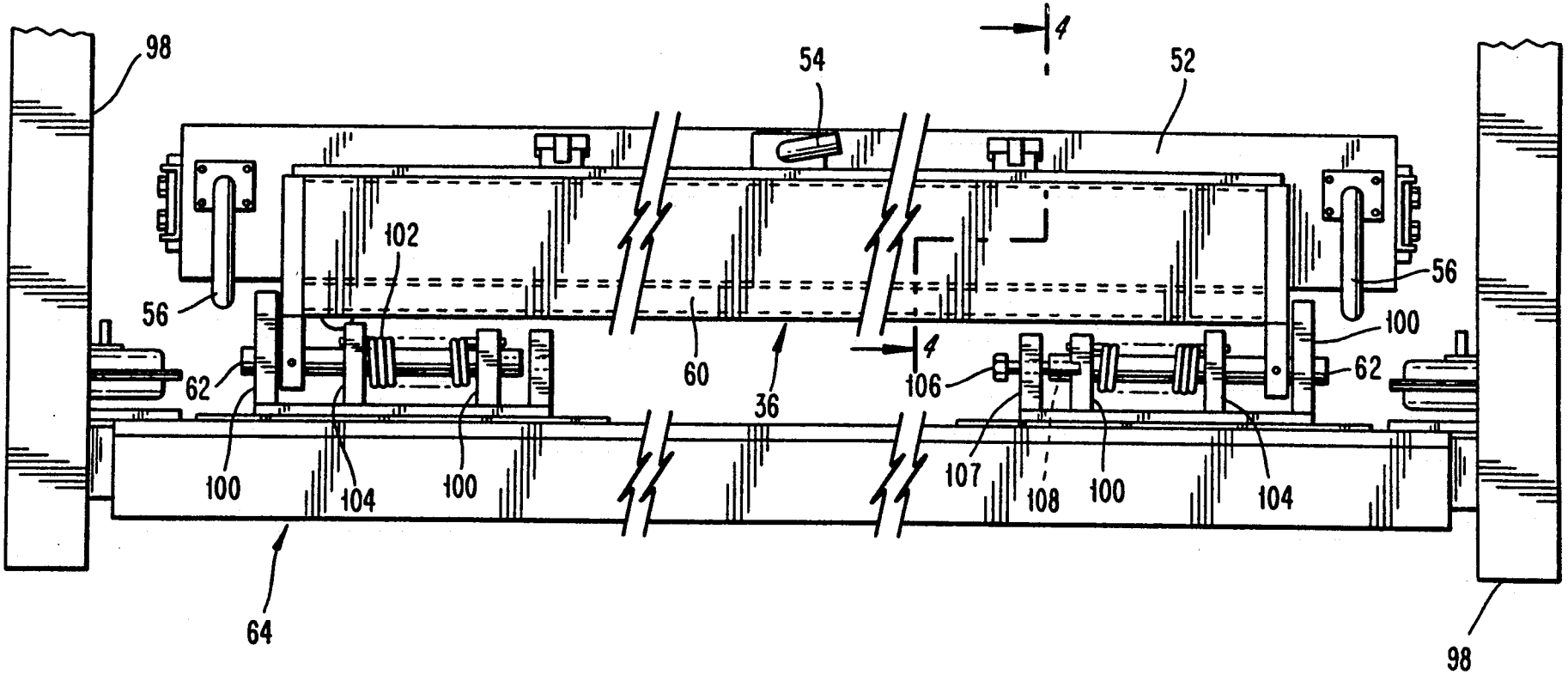
FIG. 3 is a view generally on the line 3—3 of FIG. 2 of a pivotal doctor blade head assembly, some parts being omitted for simplicity.

FIG. 3 shows a view generally on the angled line 3—3 in FIG. 2 of the whole doctor blade head assembly 36 mounted by the pair of elongate pivot pins 62 to the main frame structure portion 64 between side frame plates 98. The ink inlet pipe 54 enters the top of the body 52 centrally of the length thereof. The two ink outlet pipes 56 are located beyond the ends of the frame 60, and leave the ends of the body 52 at locations below the location of entry of the inlet pipe 54 into the body 52. The pivot pins 62 of the frame 60 are pivoted at each end in flanges 100 extending upwardly from the machine frame portion 64. A coil spring 102 encircles each pivot 62 with one end of the spring being secured to one of the flanges 100 and the other end secured to a collar 104 non-rotatably fixed on that pivot pin. When the locking pin 66 (see FIG. 2) is removed from each end of the doctor blade assembly 36 and the assembly 36 pivoted about the pivots 62 away from the anilox roll (i.e. clockwise in FIG. 2), the springs 102 are torsionally tensioned to partially counterbalance the weight of the whole assembly 36. An adjusting screw 106 is threaded through another flange 107 extending upwardly from the machine frame portion 64 of FIG. 3, the end of this screw 106 being rotatably captured in a counterbore 108 in the inner end of the righthand pivot pin 62. Rotational adjustment of the screw 106 moves the righthand pivot pin 62 axially relative to the flanges 100 in which it is journalled. Both pivot pins 62 are movable axially relative to the flanges 100. In this way, the axial position of the doctor blade assembly 36 can be adjusted axially relative to the anilox roll. Preferably, an operator rotates the adjusting screw 106 a partial turn each day to more evenly distribute any wear between the doctor blades 48, 50 and the surface of the anilox roll 32. The screw 106 can be progressively turned in one direction of rotation until it reaches a limit in that direction, whereafter it can be progressively turned in the opposite direction of rotation until it reaches the limit in the opposite direction; thereafter this adjusting cycle can be repeated. Depending upon the length of the screw 106 extending from the pivot pin 62, a complete adjusting cycle could take about one month with the screw 106 being turned one eighth of a turn each day.

Figure 4:
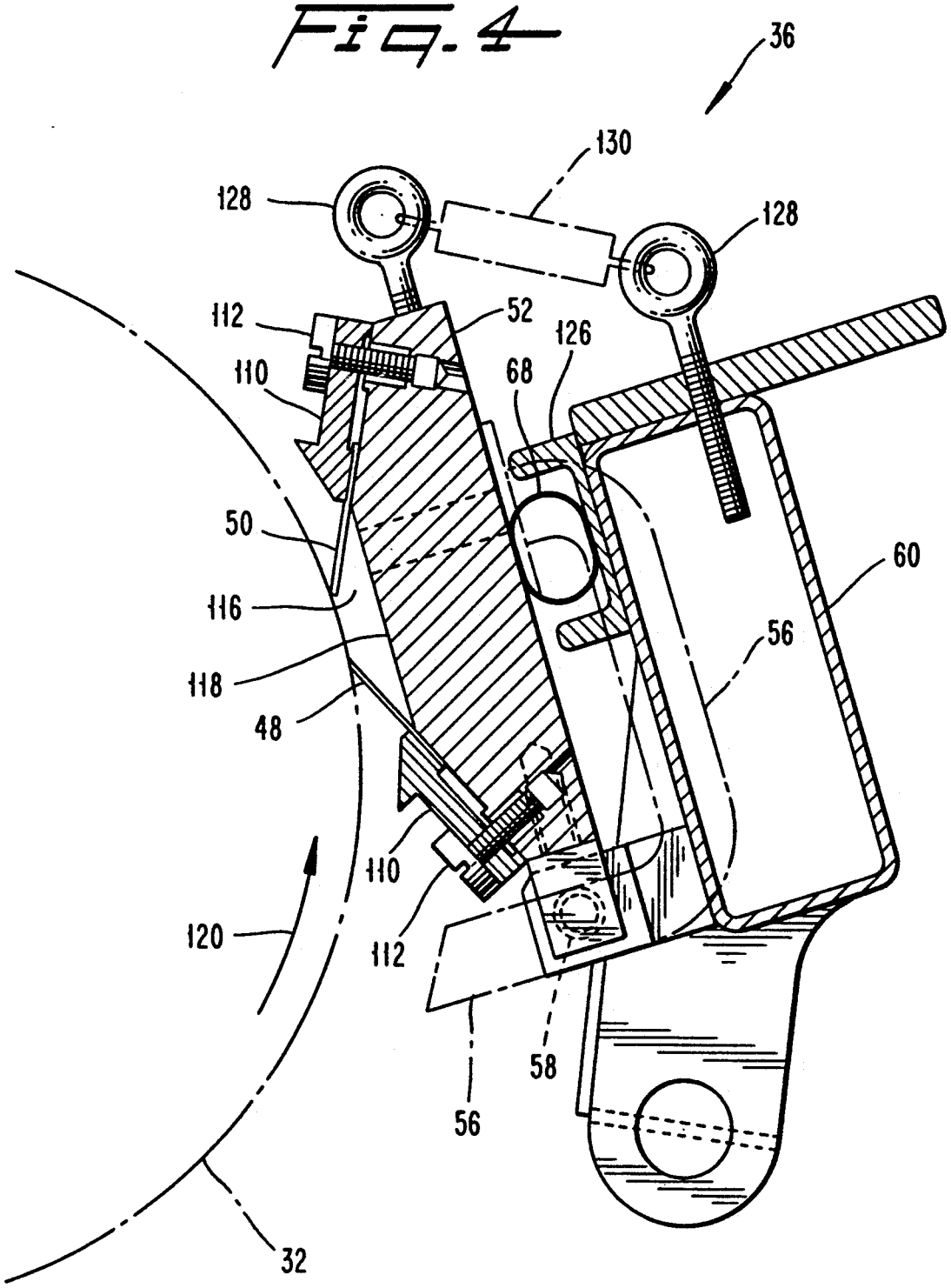
FIG. 4 is a stepped vertical section through the doctor blade head on the line 4—4 in FIG. 3.

FIG. 4 shows a vertical section through the doctor blade assembly 36 on the stepped line 4—4 in FIG. 3. The flexible doctor blades 48, 50 are clamped in adjusted position to the body 52 by backing plates 110 and clamping screws 112. An internal ink reservoir or fountain 116 is defined in the doctor blade assembly 36 between the doctor blades 48, 50, a face 118 of the body 52, and a portion of the surface of the anilox roll 32. In the direction of rotation of the anilox roll 32 shown by the arrow 120, the lower doctor blade 48 functions as an ink retaining blade forming the bottom of the reservoir 116; and the upper doctor blade 50 functions as a reverse angle doctor blade to scrape the inked surface of the anilox roll 32 and doctor the thickness of the ink film conveyed by the surface of the anilox roll to the printing plate on the print cylinder 30 (FIG. 2). The doctor blades 48, 50 may have the same flexibility or the lower blade 48 may have a greater flexibility. The lateral ends of the reservoir 116 are sealed by resilient rubber gaskets 122 (see FIG. 2) which seal against the two doctor blades 48, 50, the cylindrical surface of the anilox roll 32, and the flat ends of the body 52, the gaskets 122 being clamped in position by end plates 124 (only one of which can be seen in FIG. 2). The air tube 68 is located in a channel 126 on the frame 60. Eye bolts 128 are screwed into the tops of the body 52 and the frame 60. A coil spring 130 has its ends connected to the eyes of the bolts 128 and is under tension to resiliently urge the body 52 to pivot clockwise (in FIG. 4) about its pivot pins 58 towards the frame 60. Thus, when compressed air is introduced into the air tube 68, the expansion of the tube 68 overcomes the bias of the spring 130 and rotates the body 52 anticlockwise about the pivot pins 58 to urge the free ends of the doctor blades 48, 50 against the anilox roll 32. The degree of inflation of the tube 68 determines the pressure with which the blades 48, 50 are pressed against the anilox roll 32. Upon allowing the tube 68 to deflate by exhausting the compressed air therefrom, the spring 130 will function to pivot the head 52 clockwise and space the ends of the doctor blades 48, 50 away from and out of contact with the surface of the anilox roll 32; thus the default position of the doctor blade assembly 36 is the inoperative position with the doctor blades 48, 50 spaced from the anilox roll 32. Before allowing the assembly 36 to occupy this default position, the reservoir 116 is washed as will be explained below.

Figure 5:
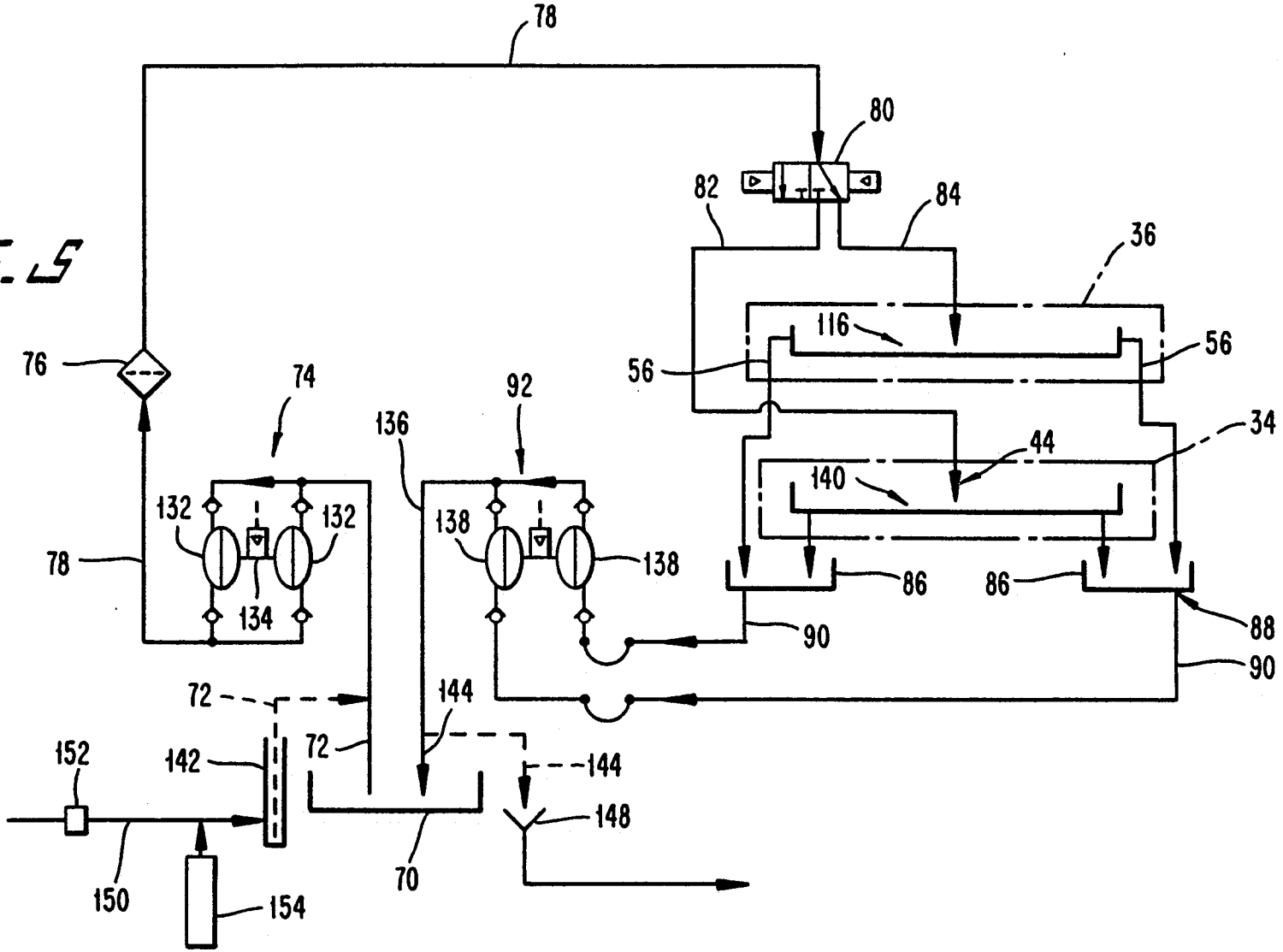
FIG. 5 is a schematic diagram illustrating the complete ink flow and wash-up systems according to the invention of either printing section of the machine of FIG. 1.

FIG. 5 schematically illustrates the alternative ink flow paths for the two inking systems, and also the modification of these paths during a wash cycle. The wash cycle is arranged to occur between changing from one inking system to the other, and should also be used before closing down the respective printing section, for example when stopping printing at the end of a day, as well as when changing inks.

For operating either inking system, the supply pipe 72 is immersed in the ink supply 70 and ink drawn from the supply 70 by the supply pump 74 which is a pneumatically operated double diaphragm pump, the two diaphragm units 132 being connected in parallel and having a common actuating piston rod 134. The supply pump 74 pumps the ink through the filter 76 to the two-way distribution valve 80 which is also pneumatically operated. Depending upon the setting of the valve 80, the ink either flows via the piping 84 to the doctor blade assembly 36 or via the piping 82 to the wipe roll 34. In either case, the excess ink from the ink fountain formed flows into the sump 86 at each lateral end of the drain tray 46 (FIG. 2). The sumps 86 are connected by the piping 90 to the return pump 92 which draws the ink from the sumps 86 and pumps it via a discharge pipe 136 back into the ink supply container 70. The return pump 92 is the same type as the supply pump 74, and each sump 86 is separately connected to a respective one of the two diaphragm units 138 of the pneumatically operated return pump 92. When the valve 80 is only supplying ink to the doctor blade assembly 36, the ink is supplied to the reservoir 116 from the inlet pipe 54 and the excess flows from the reservoir 116 via the two outlet pipes 56 to the sumps 86 (via the tray 46). When the valve 80 is switched to supply the wipe roll 34, the ink is supplied via the pipe outlet 44 to the lateral center of a reservoir 140 formed in the upper portion of the nip between the wipe roll 34 and the anilox roll 32 (in the position in FIG. 1), excess ink flowing from the open ends of this nip reservoir 140 into the sumps 86 (via the tray 46). Thus, whichever inking system is selected, the ink is supplied thereto via the distribution valve 80 and the excess in returned via the sumps 86 in the tray 46. In other words, a common ink supply and return system is employed for the two alternative inking systems.

This common ink supply and return system can also be placed in a wash cycle to wash the system. Before operating the wash cycle, an ink recovery cycle is performed. The supply pipe 72 is a flexible hose; its intake end is lifted out of the ink supply container 70 and placed in an empty standpipe 142 (this position being shown by a broken line in FIG. 5). Both pumps 74 and 92 are then operated at a faster speed, a wash speed, until the ink that was still in the system has been returned to the ink supply container 70. A pivoted end portion 144 of the discharge pipe 136 from the return pump 92 to the container 70 is pivoted by an air cylinder 192 (see FIG. 6) to the position shown by a broken line in FIG. 5 in which it registers with a drain 148. Water is then supplied to the standpipe 142 from a water line 150 by opening a solenoid operated water valve 152. Water from the water line 50 is then circulated through the respective inking system by the supply pump 74 and discharged by the return pump 92 to the drain 148. During this wash cycle, the water valve 152 is closed, a quantity of liquid soap is injected by a soap injector 154 into the water line 150, and then the water valve 152 reopened; the water from the water line 150 then forces the injected quantity of soap into the wash cycle. Also during the wash cycle, spray nozzles above the wipe and anilox rolls 34, 32 are activated and jets of water sprayed on both these rolls to wash them, the jets of water may also be sprayed into the ink pan 46 to clean it. The return pump 92 is operated at a faster rate, i.e. at a higher pumping capacity, than the supply pump 74 to ensure adequate control of the flowing liquids. At the end of the wash cycle, the water valve 152 is turned off, the system allowed to purge itself of water, and then the pumps 74, 92 switched off. Thereafter, when printing is to be recommenced, the flexible supply pipe 72 is reinserted into the ink supply 70, or into a different ink supply container if changing ink, and the end portion 144 of the return pipe 136 is pivoted back over the ink supply container, i.e. the full line positions in FIG. 5 of pipes 72 and 144 are resumed.

In addition to the automatic wash cycle above, periodic manual cleaning of various parts of the system is recommended. Also, manual cleaning of the reservoir cavity 116 of the doctor blade head assembly is recommended e.g. by temporarily removing the end gaskets. It is preferable to clean the filter 76 periodically, for example, after each time the wash cycle is performed. Apart from filtering the ink, the filter 76 performs a second function of smoothing the pumping impulses from the two diaphragm units 132 of the supply pump. Further, a second filter unit may be located between the return pump 92 and the ink supply 70.

Figure 7:
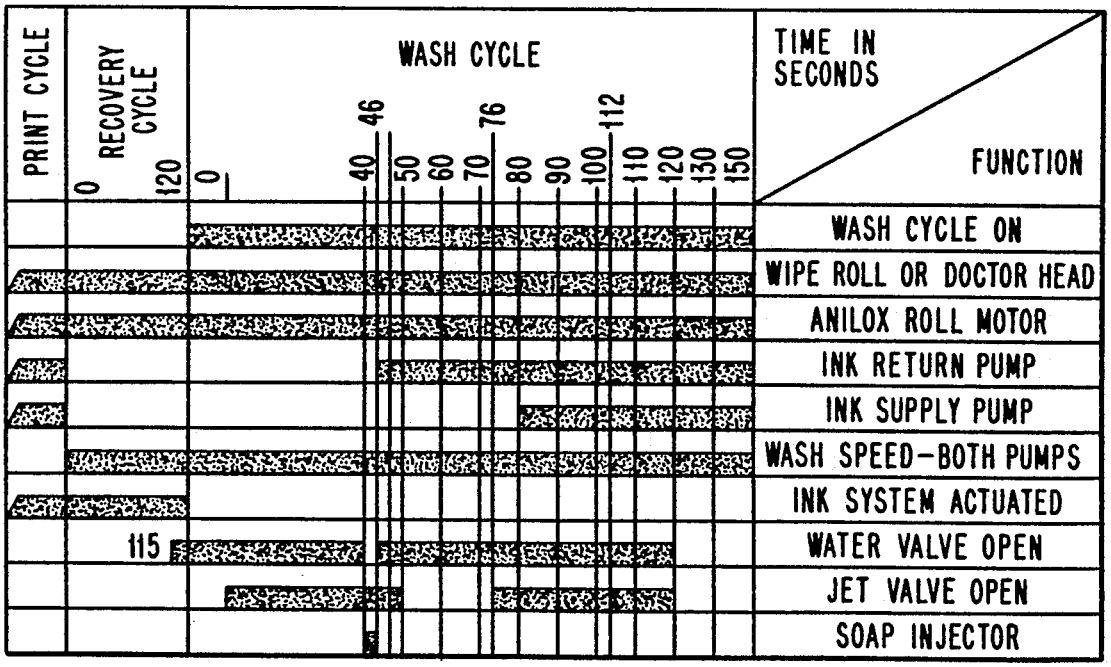
FIG. 7 is a timing diagram of the print, ink recovery, and wash cycles of each of the above printing sections.

FIG. 7 is a timing diagram illustrating the above print, recovery and wash cycles. The lefthand column represents the end of a print cycle, the next column the recovery cycle, the next and wider column represents the wash cycle, and the right column lists the functions represented in the timing diagram. The numbers in the recovery cycle and wash cycle columns indicate time in seconds into the respective cycle. The timing and sequence of operations is the same in the wash cycle regardless of whether the wipe roll system or the doctor blade system is operative when the wash cycle begins. Thus, referring to the second timing line in the diagram labelled on the right WIPE ROLL or DOCTOR HEAD, whichever of the two inking systems is in operation at the end of the print cycle stays activated in its operating position during the subsequent recovery and wash cycle with the other of the inking systems remaining in its inactive position.

The anilox roll 32 is, during normal machine operation, rotatably driven from the main drive of the machine 10, and is so rotated at a speed proportional to the throughput speed of the machine 10. However, the anilox roll 32 also has its own independent drive which constantly operates to drivingly rotate the anilox roll at a slow speed via an overrunning clutch. This slow speed is less than normal operating speed and also less than that of the wipe roll. When the main drive of machine 10 or the wipe roll 34 engages the anilox to rotate it at a faster speed, the overrunning clutch allows this. The anilox roll is constantly so driven to minimize the possibility of ink drying on it accidentally.

During the print cycle, as shown in FIG. 7, an inking system selector switch is set to select the wipe roll inking system or the doctor blade inking system; the slow running independent motor for the anilox roll is activated; the return and supply pumps 92, 74 are operating; and a switch to enable actuation of the inking system selected and indicate the inking system is operative is set to an operative position.

At the start of the ink recovery cycle, the pickup end of the supply pipe 72 is placed in the standpipe 142 and the speed of both the return and supply pumps is changed to the higher "wash speed".

The wash cycle commences just before the end of the recovery cycle with the opening of the water valve 152. Also, the pivoted end portion 144 of the discharge pipe 136 is moved over the drain 148. Then a wash cycle "on" light is illuminated, the same inking system stays selected (wipe roll or doctor head), the anilox slow drive motor continues to operate, both pumps continue at wash speed, and the water valve 152 remains open. Shortly after, a jet valve opens to cause the wipe roll 34, anilox roll 32 and ink pan 46 to be sprayed with water. Forty seconds into the wash cycle the water valve 152 closes and soap from the dispenser 154 is injected into the water line 150 for about six seconds. Thereafter, the water valve 152 is re-opened and the speed of the return pump 92 is raised by superimposing its normal operating speed on top of its wash speed. Four seconds later the jet valve is closed but re-opened again at the seventy-six second mark. Four seconds later the speed of the supply pump 74 is increased by superimposing its normal operating speed on top of its wash speed. Forty seconds later both the water valve 152 and the jet valve are closed. Thirty seconds later the wash cycle is completed, the pumps stop, and the wash cycle "on" light goes out. The ink recovery cycle takes two minutes, and the wash cycle takes two and a half minutes (although the water valve 152 first opens five seconds earlier).

Figure 6:
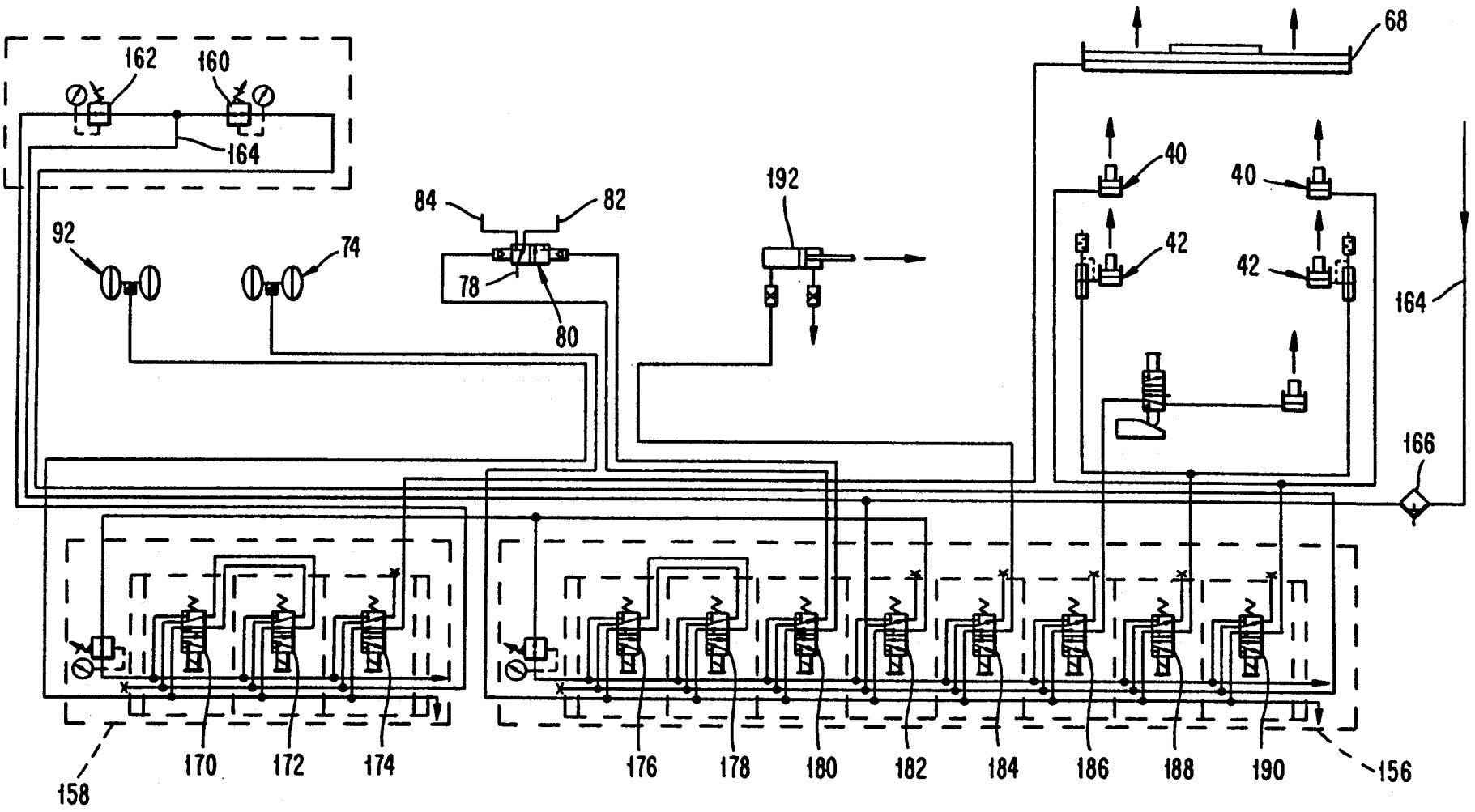
FIG. 6 is a schematic diagram illustrating pneumatic control circuitry of either of the above printing sections.

FIG. 6 is a schematic air control circuit for the two inking systems, the ink recovery cycle, and the wash cycle. Eight pneumatic controllers are grouped in a main control assembly 156 which partially controls the wipe roll inking system, and three pneumatic controllers are grouped in a supplemental control assembly 158 partially dedicated to the doctor blade inking system. These groupings are for convenience of assembly, and any other pairs of groupings or a single comprehensive grouping may be employed. A manually adjustable pressure regulator 160 controls the air supply pressure to the main control assembly 156, and a second manually adjustable pressure regulator 162 controls the air supply pressure to the control assembly 158. Compressed air is fed to the regulators 160, 162 by air supply line 164 via an air filter 166.

The supplemental control assembly 158 contains print and wash speed controllers 170, 172 for supplying the compressed air to drive the return pump 92. The assembly also contains a control valve 174 for controlling the supply of compressed air to the air tube 68 for urging the doctor blades against the anilox roll.

The control assembly 156 contains print and wash speed controllers 176, 178 for supplying the compressed air to drive the supply pump 74. It also contains a doctor blade/wipe roll system valve 180, an ink system on/off valve 182, a drain position valve 184, a brake valve 186, an anilox roll valve 188, and a wipe roll valve 190. The control valve 180 controls air supply to the ink path selector valve 80, the direction of this supply determining whether the ink outlet of the valve 80 communicates with the wipe roll ink supply pipe 82 or the doctor blade supply pipe 84. The control valve 182 determines whether the respective printing section 18, 20 of machine 10 is or is not to print and renders the control valve assemblies 156, 158 operable or not. Control valve 184 actuates the air cylinder 192 to pivot the end portion 144 of ink discharge pipe 136 between the full line and broken line positions in FIG. 5. Control valve 186 actuates a brake for locking the main gear train in the respective printing section 18, 20. Control valve 188 controls the supply of compressed air to and from the pair of air cylinders 42 for raising and lowering the anilox roll 32 relative to the print cylinder 30. Control valve 190 similarly controls the supply of air to and from the pair of air cylinders 40 for pressing the wipe roll 34 against the anilox roll 32, or for spacing the wipe roll 34 away from the anilox roll in the inoperative position shown in FIG. 2.

Figure 8:
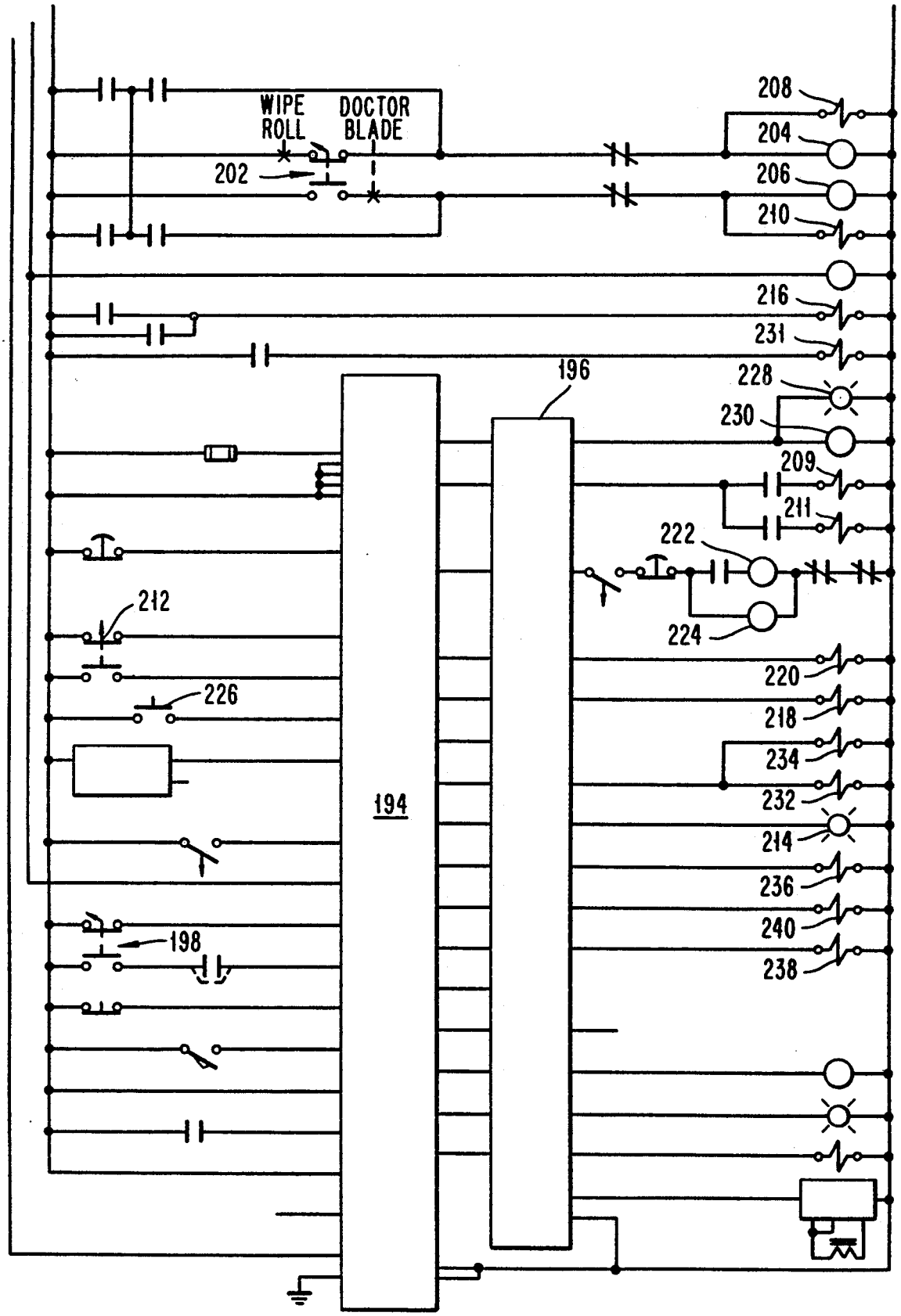
FIG. 8 is a wiring diagram for a programmable controller and printed circuit board establishing electrical interlocks between the wipe roll and doctor blade inking systems of the dual inking system and also with the wash cycle.

FIG. 8 is a schematic wiring diagram of a programmable controller 194 (a suitable controller being model number TI-140 of Texas Instrument, Industrial Control M.S. 3526 Johnson City, Tenn. 37605-1255) for interrelating and controlling the functioning of the pneumatic control valves 170 to 190, and for providing electrical interlocking to prevent changing ink system modes without first going through a wash cycle. The programmable controller 194 is connected into a printed circuit board 196 via sixteen outputs.

A manually operated switch 198 controls whether the anilox roll 32 is in an inoperative position spaced from the print cylinder 30, or in an operative position engaging the printing plate of the print cylinder. The switch 198 actuates a solenoid 200 which in turn controls the pneumatic valve 188 (FIG. 6). A print mode switch 202 enables manual selection of the wipe roll inking system or the doctor blade inking system; the switch 202 controls a wipe roll mode control relay 204 and a doctor blade control relay 206. The switch 202 also actuates solenoid 208 for causing the pneumatic valve 180 to move the ink path selector valve 80 to supply ink to the nip of the wipe roll/anilox roll; and also a solenoid 209 is actuated to cause the pneumatic valve 190 to supply compressed air to the air cylinders 40 so raising the wipe roll 34 into engagement with the anilox roll 32. The other position of the switch 202 actuates solenoid 210 for causing the pneumatic valve 180 to move the ink path selector valve 80 to supply ink to the doctor blade head assembly 36, and also at the same time for causing a solenoid 211 to actuate pneumatic valve 174 to supply compressed air to the air tube 68 so engaging the doctor blades 48, 50 against the anilox roll 32. An ink system on/off switch 212 is connected to the programmable controller 194 via two inputs and has three positions, namely off, on, and start. To print, after positioning the anilox roll with the switch 198 and selecting the inking system with the print mode switch 202, the ink system switch 212 is moved to the start position which illuminates an "ink system on" light 214 and actuates a solenoid 216 for activating the pneumatic valve 182 to activate both control panels 156, 158 for inking. The switch 212 is then released and automatically assumes the "on" position with the light 214 remaining illuminated. This actuation of the switch 212 also energizes solenoids 218, 220 which operate pneumatic valves 176, 170, respectively, to determine the pumping speed of the supply and return pumps 74, 92 during printing. Further, this actuation of switch 198 turns on a wipe roll drive motor 222 (if the print mode switch 202 has preselected the wipe roll mode and actuated the wipe roll mode control relay 204), and the anilox idle speed motor 224. The wipe roll motor 222 drivingly rotates the wipe roll at a constant speed regardless of machine speed (i.e. regardless of the speed of the print cylinder 30). The anilox motor, as previously described, drives the anilox roll through an overrunning clutch so that should the main drive to the anilox roll stop or fail, then the anilox roll will continue to be driven at an idle speed to protect against ink drying out on the anilox roll.

At the end of a printing run, to commence with the recovery cycle and wash cycle, the ink system switch 212 is turned to the "off" position. After the recovery cycle is completed, a wash light 228 comes on and a wash mode control relay 230 is activated. A solenoid 231 is actuated to operate the pneumatic valve 184 to supply compressed air to the air cylinder 192 to move the end 144 of the discharge pipe 136 to the broken line position in FIG. 5. Through the programmed controller 194, solenoids 232, 234, 236, 238, and 240 are actuated in timed sequence to operate the pneumatic valve 178, the pneumatic valve 172, the water valve 152 (FIG. 5), the soap injector 154 (FIG. 5), and the water jet valve for spraying the rolls 32, 34 and the ink pan 46. Once the wash cycle is initiated, the controller 194 causes all the functions shown in FIG. 7 in the Wash Cycle to occur in their correct timed sequences. When the wash cycle is completed, the wash light 228 goes out, and the discharge pipe is repositioned over the ink supply 70 (FIG. 5), and the various drives are stopped. A wash cycle can be repeated, if desired, by actuation of "wash" switch 226.

The programmable controller 194 is programmed to cause the selected print mode to be latched as selected, even if the print mode switch 202 is manually switched to the other print mode, once the ink system switch 212 has been actuated through "start" to "on". This electrical interlocking is to prevent print modes being changed once the selected inking system has started. To change print modes, the ink system must be turned off and a wash cycle selected and completed. At the completion of the wash cycle, the programmable controller 194 releases the electrical interlocking of the respective wipe roll system control relay 204 or doctor blade system control relay 206, as the case may be, to enable either inking system to be operated in accordance with the selection made with the print mode switch 202. Therefore, to recommence printing, the mode selection by the switch 202 is checked and changed if necessary, and then the ink system switch 212 is turned to the "start" position and released into the "on" position.

Figure 9:
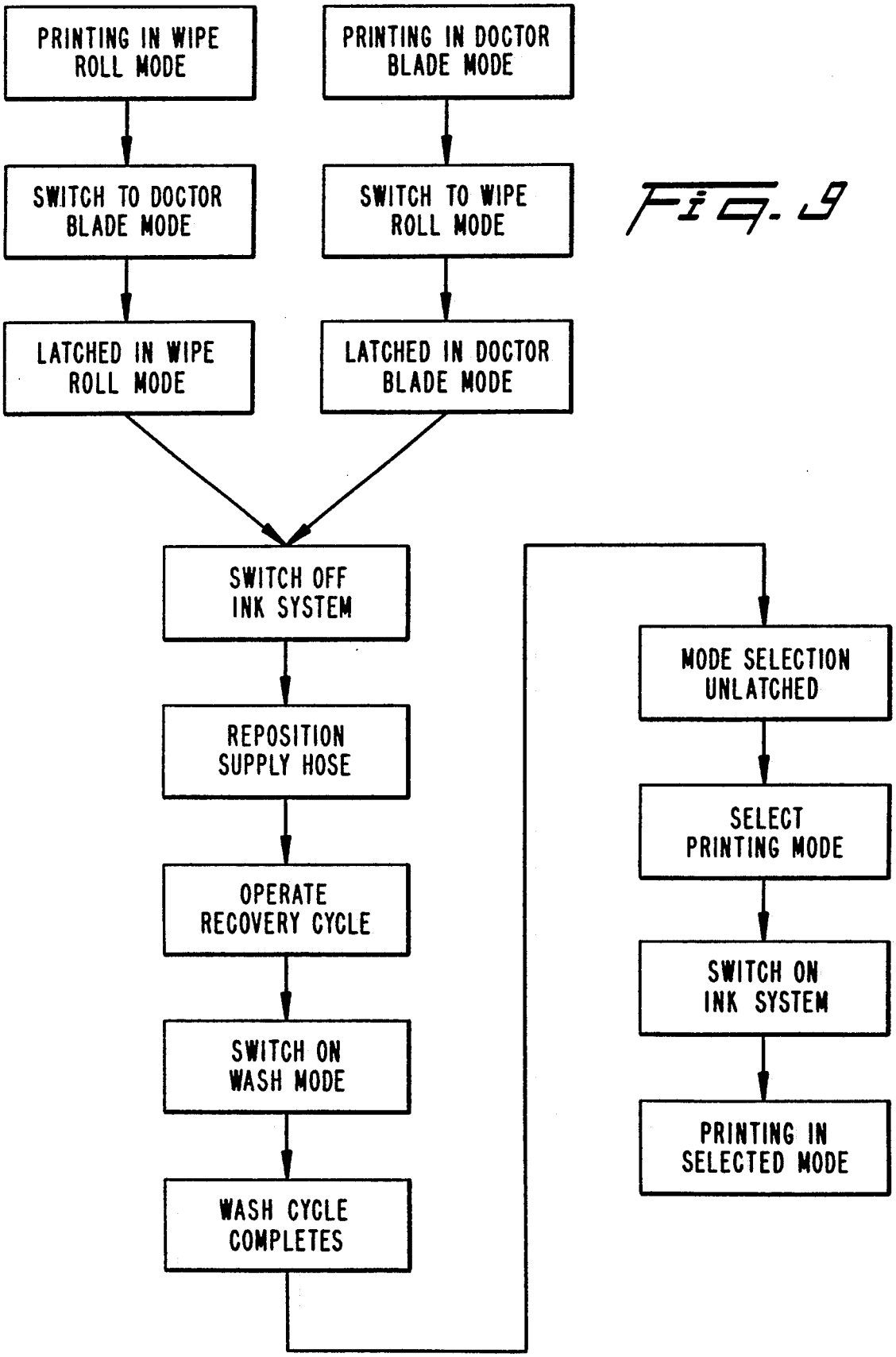
FIG. 9 is a diagram illustrating the interlock that occurs and the sequences that are progressed through when changing between the wipe roll inking system and the doctor blade inking system.

FIG. 9 illustrates the sequence of steps imposed by the logic of the programmable controller 194 when trying to change from one mode of inking system to the other. Once the printing section 18 or 20 (FIG. 1) has been subjected to a complete wash cycle, then either mode of inking can be freely chosen and printing carried out with that printing section in that mode of inking. However, the programmable controller 194 prevents the mode of printing to be changed unless a wash cycle is first completed.

Progressing through the boxes of FIG. 9, while printing in either mode of inking, if the print mode switch 202 is turned to the other mode of inking, nothing happens because the operating mode of inking has been latched in by the programmable controller 194. To effect a change of inking mode it is necessary to actuate switch 212 to switch off the ink system. Then the pick-up end of the supply hose 72 is manually removed from the ink supply and repositioned in the standpipe 142 (FIG. 5). Thereafter, it is advantageous to operate the recovery cycle (FIG. 7) to recover unused ink in the system. After the wash cycle of FIG. 7 has been completed, the programmable controller 194 unlatches the inking mode in operation when printing was stopped. Now, either printing mode can be selected, i.e. the wipe roll system or the doctor blade system, with the print mode switch 202 and inking commenced by switching on the ink system switch 212.

It will be appreciated that the above dual inking system effectively occupies no more space than a single inking system, i.e. either a wipe roll system or a reverse angle doctor blade system. Also, this dual inking system employs a minimum increase in the number of parts over a single inking system; this is achieved by employing a common anilox roll, a common ink pan, and virtually a common ink circulating system and a common wash-up system.

It will also be appreciated that by providing an interlock that latches in a selected inking system until a wash cycle is completed, inadvertent change from one inking system to the other in the middle of a printing run is virtually eliminated. Also, allowing ink to dry on and/or contaminate the inking system being used, when changing to the other system, is virtually eliminated; the system has to be ready for shutdown before the inking system can be changed.

The above described embodiments, of course, are not to be construed as limiting the breadth of the present invention. Modifications, and other alternative constructions, will be apparent which are within the spirit and scope of the invention as defined in the appended claims.

What is claimed is:

1. Printing apparatus, comprising:

a frame structure;

a print cylinder rotatably mounted in said frame structure:

an ink roll rotatably mounted in said frame structure and engageable with said print cylinder for transferring ink thereto;

a wipe roll rotatably mounted in said frame structure;

means for moving said wipe roll into and out of engagement with said ink roll;

a doctor blade head assembly;

means for moving said doctor blade head assembly into and out of engagement with said ink roll;

selection means for actuating said wipe roll moving means and said doctor blade head assembly moving means for selectively engaging either of said wipe roll and said doctor blade head assembly with said ink roll and spacing the other of said wipe roll and said doctor blade head assembly from and out of contact with said ink roll to enable either a wipe roll inking system or a doctor blade inking system to be selected for printing;

means for supplying ink directly to only one of said wipe roll and said doctor blade head assembly at a time, and only while said one is selectively engaged with said ink roll by said selection means; and said ink supplying means including a valve, actuated by said selection means between two distribution positions, for directing said ink to said one selectively engaged with said ink roll.

2. The printing apparatus of claim 1, wherein said wipe roll and said doctor blade head assembly are located on opposite sides of said ink roll.

3. The printing apparatus of claim 2, wherein said wipe roll, ink roll and doctor blade head assembly are disposed below said print cylinder.

4. The printing apparatus of claim 1, further comprising:

a drain tray disposed underneath said wipe roll and said ink roll to collect any excess ink supplied to said wipe roll; and means, associated with said doctor blade head assembly, for enabling any excess ink supplied to said doctor blade head assembly to be collected by said drain tray.

5. The printing apparatus of claim 4, further comprising:

an ink supply pump having an output connected to said valve;

an ink return pump having an input connected to said drain tray; and an input of said supply pump and an output of said return pump both being connectable to a supply of ink.

6. The printing apparatus of claim 1, further comprising:

washing means for operating a wash cycle for washing ink from said printing apparatus after a printing run; and interlocking means for preventing said selection means from engaging said other of said wipe roll and said doctor blade head assembly with said ink roll until said washing means has been actuated to effect said wash cycle.

7. Printing apparatus, comprising:

a rotatable print cylinder;

a rotatable anilox roll disposed parallel to and below said print cylinder and engageable with said print cylinder for transferring ink thereto;

a rotatable wipe roll and a doctor blade head assembly disposed below said print cylinder and on opposite sides of said anilox roll;

said wipe roll being cooperative with said anilox roll to form a wipe roll inking system, and said doctor blade head assembly being cooperative with said anilox roll to form an alternative doctor blade inking system;

means for selectively activating either of said inking systems and simultaneously disengaging the other of said inking systems;

a supply pump for supplying ink; and said means including a distribution valve selectively movable between two distribution positions to connect said supply pump to pump ink dirctly to said wipe roll or said doctor blade head assembly depending upon which inking system is in use.

8. The printing apparatus of claim 7, wherein said doctor blade head assembly has two doctor blades defining an ink reservoir therebetween.

9. The printing apparatus of claim 8, wherein said doctor blade head assembly is pivotally mounted on a frame and is resiliently biased away from said anilox roll to space said doctor blades from said anilox roll and includes air inflatable means for pivoting said doctor blade head assembly to engage said blades with said anilox roll in dependence upon compressed air supplied to said air inflatable means, supply of said compressed air to said inflatable means being effected by said means for permitting use and enabling selection.

10. Printing apparatus, comprising:

a rotatable print cylinder;

a rotatable anilox roll engageable with said print cylinder for transferring ink thereto;

a rotatable wipe roll cooperable with said anilox roll to effect a wipe roll inking system for inking said anilox roll;

a doctor blade head cooperable with said anilox roll and having two doctor blades defining an ink reservoir therebetween with said anilox roll to effect a doctor blade inking system for inking said anilox roll;

said doctor blade head having an ink passageway therein communicating with said ink reservoir;

means for enabling selection of either inking system;

in said wipe roll inking system, said wipe roll and said anilox roll cooperatively defining an upper nip trough;

ink supplying means for supplying ink; and said selection enabling means including a distribution system connecting said ink supplying means directly to said upper nip trough only in said wipe roll inking system and to said ink passageway only in said doctor blade inking system.

11. The printing apparatus of claim 10, further comprising:

washing means for performing a wash cycle to wash either inking system after use; and interlocking means for preventing change from either inking system when in use to the other inking system until a wash cycle has been performed by said washing means.

12. The printing apparatus of claim 10, wherein:

said ink supplying means comprises a supply pump for pumping ink; and said distribution system includes a distribution valve selectively movable between two distribution positions to connect said supply pump to supply ink to said wipe roll or said doctor blade head depending upon which inking system is in use.

13. The printing apparatus of claim 12, further comprising a common drain tray below both said wipe roll and said doctor blade head for receiving ink therefrom.

14. The printing system of claim 13, further comprising a return pump connected to said tray to draw ink therefrom.

15. The printing system of claim 14, wherein said supply pump has an inlet connected to a source of ink and said return pump has an outlet connected to said source of ink.

16. The printing system of claim 11, wherein:

said ink supplying means comprises an ink supply pump operable to supply ink from an ink source in either inking system; and further comprising collecting means for collecting excess ink flowing from either inking system in use;

an ink return pump operable to return ink from said collecting means to the ink source; and wherein said washing means includes means for connecting a supply of water to said supply pump and means for connecting said return pump to a drain.

17. Printing apparatus, comprising:

a frame structure;

a print cylinder rotatably mounted in said frame structure;

an anilox roll rotatably mounted in said frame structure below but cooperable with said print cylinder;

a rotatable wipe roll and a doctor blade head mounted in said frame structure below said print cylinder and on opposite sides of said anilox roll;

an ink pan disposed below said wipe and anilox rolls;

means for moving said wipe roll into engagement with or away from said anilox roll;

means for moving said doctor blade head into engagement with or away from said anilox roll;

said doctor blade head having two doctor blades engageable with said anilox roll and defining an ink reservoir therebetween;

said doctor blade head having an ink inlet and at least one ink outlet, said ink outlet delivering ink from said doctor blade head to said ink pan;

a source of ink;

a supply pump connected between said source of ink and a two-position distribution valve selectably changeable to supply ink to either said wipe roll or to said ink inlet of said doctor blade head;

a return pump connected between said ink pan and said source of ink;

means for selecting alternative wipe roll and doctor blade inking systems;

said wipe roll inking system involving having said wipe roll engaged with said anilox roll, said doctor blade head spaced from and out of contact with said anilox roll, and said distribution valve connected to supply ink only to a nip trough between said wipe and anilox roll;

said doctor blade inking system involving having said wipe roll spaced from said anilox roll, said doctor blade head engaged with said anilox roll, and said distribution valve connected to supply ink only to said doctor blade head reservoir;

washing means for performing a wash cycle to wash either inking system after use; and interlocking means for preventing changeover from use of either inking system to the other by said selecting means until after said washing means has been activated and a wash cycle completed.

18. The printing apparatus of claim 17, wherein said return pump comprises dual pumping units respectively connected separately to two sumps on opposite sides of said ink pan, and a filter unit is connected between said source of ink and said distribution valve.

19. A flexographic printing apparatus, comprising:

a rotatable print cylinder;

a rotatable impression roll cooperable with said print cylinder to print sheet material therebetween;

an anilox roll cooperable with said print cylinder for transferring ink thereto;

a wipe roll engageable with said anilox roll to form a wipe roll inking system for inking said anilox roll with a nip being formed between the wipe roll and the anilox roll;

a doctor blade head having at least one doctor blade engageable with said anilox roll to form a doctor blade inking system for inking said anilox roll with a cavity for ink being defined between said anilox roll and said doctor blade head;

said nip and said cavity occurring at different locations relative to said anilox roll;

means for supplying ink to either of said inking systems; and means for selectively operating said ink supplying means in a wipe roll mode or an alternative doctor blade mode, in said wipe roll mode said ink being supplied to the nip between said wipe and anilox rolls to form an ink fountain in said nip, and in said doctor blade mode said ink only being supplied to said cavity defined between said anilox roll and said doctor blade head to form an ink fountain in said cavity.

20. The printing apparatus of claim 19, including two passageways, wherein said selectively operating means includes a valve which controls supply of ink to either of said two passageways, one passageway discharging ink above said nip and the other passageway discharging ink inside said doctor blade head.

21. A flexographic printing apparatus, comprising:

a frame structure;

a print cylinder rotatably mounted in said frame structure;

an anilox roll rotatably mounted in said frame structure and cooperable with said print cylinder;

a rotatable wipe roll and a doctor blade head mounted on opposite sides of said anilox roll;

an ink pan disposed below said wipe and anilox rolls;

said wipe roll being movable into engagement with or away from said anilox roll;

said doctor blade head being movable into engagement with or away from said anilox roll;

said doctor blade head including two doctor blades engageable with said anilox roll and deining an ink reservoir therebetween;

said doctor blade head having an ink inlet and at least one ink outlet, said ink outlet allowing discharge of ink from said ink reservoir to said ink pan;

a source of ink;

a supply pump connected between said source of ink and a two-position distribution valve said valve being selectably changeable to supply ink directly to eighter said wipe roll or said doctor blade head;

alternative wipe roll and doctor blade inking systems;

said wipe roll inking system comparising having said wipe roll engaged with said anilox roll, and said distribution valve connected to supply ink directly to a nip trough between said wipe and anilox rolls;

said doctor blade inking system comprising having said wipe roll spaced from said anilox roll, said doctor blade head engaged with said anilox roll, and said distribution valve connected to supply ink directly to said doctor blade head reservoir via said doctor blade head ink inlet; and means for selecting either of said wipe roll and doctor blade inking systems.

* * * * *